United States Patent [19]

Peot

[11] 4,296,290

[45] Oct. 20, 1981

[54] SAFETY LOCK-ON MOTOR CONTROL

[75] Inventor: David G. Peot, Easley, S.C.

[73] Assignee: The Singer Company, Stamford, Conn.

[21] Appl. No.: 112,681

[22] Filed: Jan. 16, 1980

[51] Int. Cl.[3] ..... H01H 9/20

[52] U.S. Cl. ..... 200/325; 200/157

[58] Field of Search ..... 200/157, 321, 327, 328, 200/334, 329, 323, 325, 322, 324, 42 T, 340; 318/345 R, 346; 338/198, 200

[56] References Cited

U.S. PATENT DOCUMENTS

| | | | |
|---|---|---|---|
| 2,484,147 | 10/1949 | Bartel | 200/157 |
| 2,810,050 | 10/1957 | Johnson | 200/325 |
| 3,345,489 | 10/1967 | Kemnitz | 200/340 |
| 3,378,662 | 4/1968 | Sorenson | 200/157 |
| 3,781,579 | 12/1973 | Rosenthal, Jr. et al. | 200/340 |

FOREIGN PATENT DOCUMENTS

| | | | |
|---|---|---|---|
| 1038429 | 9/1978 | Canada | 200/325 |
| 2725797 | 12/1978 | Fed. Rep. of Germany | 74/526 |
| 413069 | 11/1966 | Switzerland | 200/157 |
| 731687 | 6/1955 | United Kingdom | 200/334 |

*Primary Examiner*—John W. Shepperd

*Attorney, Agent, or Firm*—Elliot A. Lackenbach; Robert E. Smith; Edward L. Bell

[57] ABSTRACT

A trigger control switch with speed control having a lock-on button on the side thereof is provided with a tab or protrusion extending radially outwardly of the lock pin, a slot is provided extending longitudinally of the lock barrel and a compression spring surrounding the lock pin within the lock barrel has one end portion thereof torsionally engaged with the lock barrel and the other end portion thereof engaged with the lock pin to bias the tab or protrusion out of alignment with the slot to prevent inadvertent depression of the lock pin while enabling an operator to rotate the tab or protrusion into alignment with the slot and thereafter depress the lock pin to provide lock-on effectuation.

7 Claims, 3 Drawing Figures

SAFETY LOCK-ON MOTOR CONTROL

DESCRIPTION

1. Field of the Invention

This invention relates to motor tools and, more particularly, to safety lock-on motor controls therefore.

2. Background of the Invention

Motor powered electric tools such as portable drills, sabre saws, and the like have been heretofore provided with trigger switches, often of a variable speed motor control type provided with a lock button on the side of the switch body. These types of controls normally operate by the operator depressing the trigger and then pushing the lock button in while relaxing pressure on the trigger. This will lock the switch on and, if a variable speed control, will lock the switch at a selected speed. A control of this general type incorporating a lock-on button and variable speed is disclosed, for example, in Winchester et al U.S. Pat. No. 3,439,248, assigned to the assignee of the instant application, and incorporated herein by reference as fully and completely as if reproduced hereat.

In such prior art lock-on switch or control assemblies, it is possible for the lock button to be accidentally depressed simultaneously with the trigger so that the switch or control is accidentally locked on. Under certain conditions such as sequence of operations could be dangerous.

OBJECTS OF THE INVENTION

Bearing in mind the foregoing, it is a primary object of the present invention to provide a lock-on trigger switch or control more resistant to inadvertent lock-on operation then heretofore available designs.

Another primary object of the present invention, in addition to the foregoing object, is the provision of a trigger switch or control for motor tools, or the like, incorporating a lock-on button on the side thereof together with means for blocking the lock-on button preventing an inadvertent depression but which enables the lock-on button to be rotated and then depressed to provide a lock-on mode of operation which is easy to effectuate intentionally yet difficult to effectuate accidentally.

Another primary object of the present invention, in addition to each of the foregoing objects, is the provision of such a switch or speed control which is economical to manufacture and durable, safe and reliable in use.

Yet still another primary object to the present invention, in addition to each of the foregoing objects, is the provision in a trigger switch or speed control having a lock-on button on the side thereof, of a tab or protrusion on the side of the lock pin, a slot added to the lock barrel and the compression spring surrounding the lock pin having one end mounted torsionally with the barrel end and the other end mounted torsionally with the lock pin to angularly displace the tab from the slot unless manually rotated by the operator into alignment therewith.

It is a feature of the present invention that it is of especial utility in portable electric power motor tools such as drills, hand grinders, sabre saws, and the like.

The invention resides in the combination, construction, arrangement and disposition of the various component parts and elements incorporated in improved switches or speed controls in accordance with the principles of this invention. The present invention will be better understood and objects and important features other than those specifically enumerated above will become apparent when consideration is given to the following details and description which, when taken in conjunction with the annexed drawing describes, discloses, illustrates and shows a preferred embodiment or modification of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

In accordance with the present invention a trigger control switch with speed control having a lock-on button on the side thereof is provided with a tab or protrusion extending radially outwardly of the lock pin, a slot is provided extending longitudinally of the lock barrel and a compression spring surrounding the lock pin within the lock barrel has one end portion thereof torsionally engaged with the lock barrel and the other end portion thereof engaged with the lock pin to bias the tab or protrusion out of alignment with the slot to prevent inadvertent depression of the lock pin while enabling an operator to rotate the tab or protrusion into alignment with the slot and thereafter depress the lock pin to provide lock-on effectuation.

DESCRIPTION OF THE DRAWINGS

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows a preferred embodiment or modification of the present invention and what is presently considered and believed to be best mode of practicing the principles thereof and wherein:

DETAILED DESCRIPTION OF THE INVENTION

Figure 1:
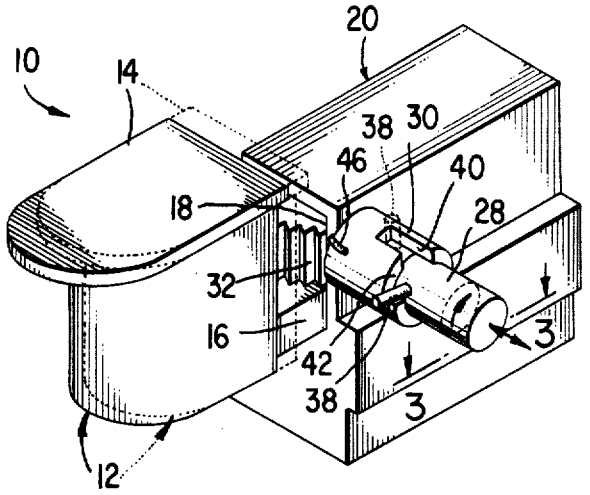
FIG. 1 is an isometric illustration of a speed control switch assembly constructed in accordance with the principles of the present invention illustrating in solid lines the off position thereof and in broken lines, a lock-on configuration thereof.
Figure 2:
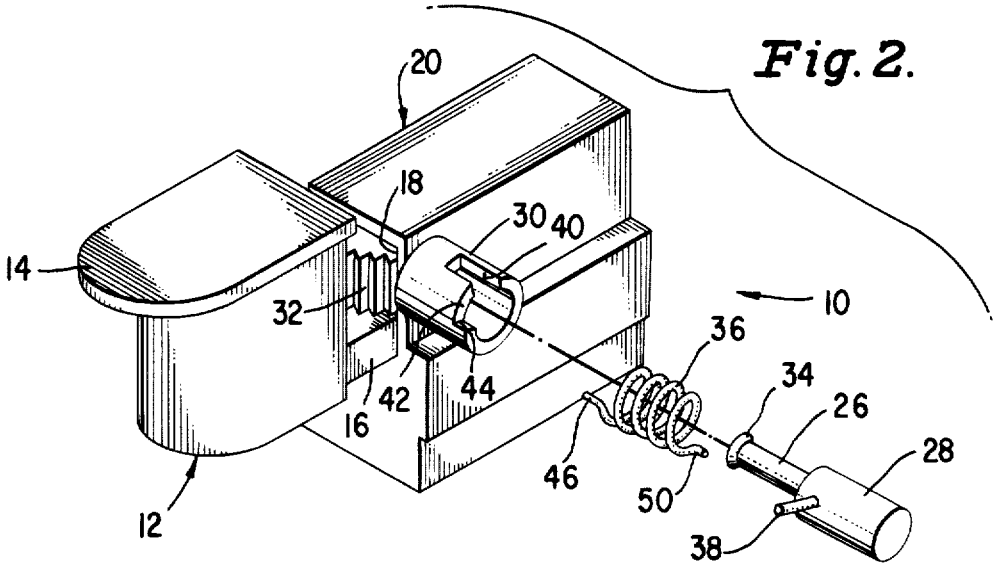
FIG. 2 is a perspective illustration similar to FIG. 1 showing the lock-on button in exploded view.
Figure 3:
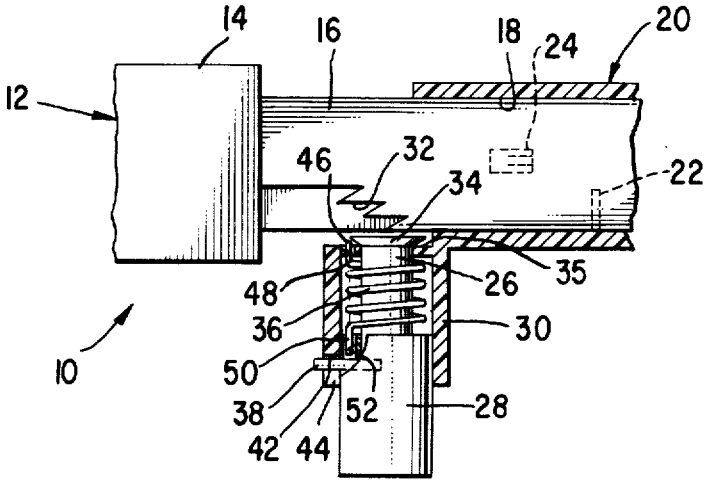
FIG. 3 is an enlarged cross sectional partial illustration taken along lines 3—3 of FIG. 1.

With reference now to the drawing, there is shown and illustrated a speed control switch assembly constructed in accordance with the principles of the present invention and designated generally by the reference character 10. The assembly 10 comprises a trigger 12, made of molded insulating material which has a body portion 14 and a slide portion 16 that extends into a through-bore 18 of a generally rectangular switch housing 20, also made of molded insulating material. The slide portion 16 carries a number of contacts, wipers, and the like, as exemplified by the contact 22 and speed control resistor wiper 24 and the housing 20 within the through-bore 18 contains mating contact and circuit elements (not shown) in a manner well known to those skilled in the switch and control art, and which forms no part of the present invention such that any known arrangement switch elements, contact, circuit element and control may be utilized to provide on-off or variable-speed control as desired.

A spring-retracted lock pin 26 actuated by a lock button 28 working in a guide bushing or barrel 30 secured to the housing 20 cooperates with a "stair step" cam 32 formed in the trigger 12 to provide means for locking the trigger 12 in a desired "on" position. Such desired "on" position may, in the case of a variable speed control as shown, comprise "on" at a desired speed. Instant release of the trigger 12 is provided by merely depressing the trigger 12 until the head 34 of the lock pin 26 clears the "stair step" cam 32. The head 34 of the lock pin 26 is of enlarged, for example mushroom shaped or inverted frusto-conical configuration as shown so as to lock with the complimentary teeth of the "stair step" cam 32 which are also sloped to provide such locking action. A compression spring 36 is provided surrounding the lock pin 26 within the barrel 30 for biasing the lock pin 26 outwardly of the trigger 12 and stop means, such as a shoulder 35 is provided for retaining the lock pin head 34 within the housing.

As thus far described, a heretofore known trigger switch or speed control has been described having a trigger linearly movable with respect to a stationary housing has been described including means for selectively locking said trigger in any of a number of "on" positions. The switch as thus far described is normally operated by depressing the trigger and then pushing the lock button in while relaxing pressure on the trigger to lock the switch "on". Such a switch could be inadvertently locked in the "on" position if the lock pin were accidentally depressed at an inadvertent time.

To prevent accidentally locking the switch 10 in the "on" position, in accordance with the present invention, a tab or protrusion 38 in the form of a cylindrical pin, or the like, is provided extending generally radially outwardly of the lock pin 26, more specifically, extending generally radially outwardly of the lock button portion 28 thereof. A mating generally longitudinally extending slot 40 is also provided in the barrel 30 for enabling the tab of protrusion 38 to slide therewithin when aligned therewith so that the lock pin 26 may, when desired, be depressed to engage the lock pin head 34 with "stair step" cam 32.

Further, the barrel 30 is provided with a transverse slot segment 42 extending perpendicular the longitudinal slot 40 and terminating in a shoulder stop 44 so that the tab 38 may move in an L-shaped path inwardly and outwardly longitudinally along the slot 40 or rotatably along the slot segment 42 and away from the longitudinal slot 40 until it engages the stop shoulder 44. The compression spring 36 has its inner end portion 46 engaged with the housing, particularly within the barrel 30 thereof, as by being inserted through an aperture or slot 48 extending therethrough and also has its outer end portion 50 engaged with the lock button 28, as by being inserted in a generally longitudinal eccentric aperture 52 provided therein parallel and offset the lock button axis, with the spring 36 being pretensioned in torsion to provide torsion to the lock button 28, in the counterclockwise direction as viewed in FIG. 1 so as to bias the tab 38 toward engagement with the shoulder stop 44.

To activate the lock-on, the lock button 28 must be rotated clockwise to align the tab 38 with the longitudinal slot 40 in the barrel 30, at which time the switch 10 can be locked by pushing the lock button 28 toward the switch body 20 after having activated the trigger 12. To release the lock, the trigger is pulled in the on direction, at which time the head 34 of the lock pin 26 is released from the "stair step" cam 32, the lock button 28 pops up by extension of the compressed spring 38 and is rotated by torsion therefrom so that the tab 38 moves in the transverse slot segment 42 until it engages the shoulder stop 44 so that the tab 38 and the longitudinal slot 40 are misaligned, the inner edge of the transverse slot blocking the tab or protrusion 38 from movement towards the trigger 12 and thereby preventing accidental depression of the lock button 28 and inadvertent effectuation of a "lock-on" condition.

While the invention has been described, disclosed, illustrated and shown in terms of a preferred embodiment or modification which it has assumed in practice, it is to be expressly understood that this has been done for purposes of example only and that the invention is not intended to be deemed limited thereby, and that other embodiments or modifications that may be suggested to those having the benefit of the teachings herein are intended to be reserved especially as they fall within the scope and spirit of the claims here appended.

What is claimed is:

1. In a trigger control for motor tools, or the like, incorporating a lock-on button on the side thereof; blocking means for blocking the lock-on button in a first rotational position of said button preventing an inadvertent depression but which enables the lock-on button to be rotated to a second rotational position and then depressed to provide a lock-on mode of operation which is easy to effectuate intentionally and having biasing means for automatically rotating said button when released from said second rotational position to said first rotational position so that such lock-on action is yet difficult to effectuate accidentally.

2. Trigger control defined in claim 1 wherein said lock-on button includes a lock pin slidable within a barrel and said means for blocking comprises a tab or protrusion on the side of the lock pin and a longitudinal slot provided in the lock barrel and said biasing means comprises a compression spring surrounding the lock pin having one end mounted torsionally with the barrel end and the other end mounted torsionally with the lock pin to angularly displace the tab from the slot unless manually rotated by the operator into alignment therewith whereat said tab can slide in the slot to enable depression of said lock pin.

3. Trigger control defined in claim 2 wherein said means for blocking further comprises a transverse slot segment extending perpendicular said longitudinal slot and terminating in a shoulder stop so that said tab may move in an L-shaped path inwardly and outwardly longitudinally along said longitudinal slot or rotatably along said transverse slot segment and away from said longitudinal slot until it engages said stop shoulder.

4. Safety lock-on motor control comprising a housing made of insulating molded material with a through-bore extending therethrough, a trigger made of insulating molded material having a body portion and a slide portion that extends into said through-bore of said housing, mating contact elements carried by said housing within said through-bore and by said slide portion of said trigger, a stair-step cam carried by said trigger and a lock-on button on the side of said housing for selective operator engagement with said stair-step cam and blocking means for blocking the lock-on button in a first rotational position of said button preventing an inadvertent depression but which enables the lock-on button to be rotated to a second rotational position and then depressed to provide a lock-on mode of operation which is easy to effectuate intentionally and having biasing means for automatically rotating said button when released from said second to said first rotational position so that such lock-on action is yet difficult to effectuate accidentally.

5. Safety control defined in claim 4 wherein said lock-on button includes a lock pin slidable within a barrel and said means for blocking comprises a tab or protrusion on the side of the lock pin, a longitudinal slot provided in the lock barrel and a compression spring surrounding the lock pin having one end mounted torsionally with the barrel end and the other end mounted torsionally with the lock pin to angularly displace the tab from the slot unless manually rotated by the operator into alignment therewith whereat said tab can slide in the slot to enable depression of said lock pin.

6. Trigger control defined in claim 5 wherein said means for blocking further comprises a transverse slot segment extending perpendicular said longitudinal slot and terminating in a shoulder stop so that said tab may move in an L-shaped path inwardly and outwardly longitudinally along said longitudinal slot or rotatably along said transverse slot segment and away from said longitudinal slot until it engages said stop shoulder.

7. A trigger control switch having a lock-on button on the side thereof including a lock pin slidable within a lock barrel and a compression spring surrounding the lock pin within the barrel wherein a tab or protrusion is provided extending radially outwardly of the lock pin, a slot is provided extending longitudinally of the lock barrel and the compression spring has one end portion thereof torsionally engaged with the lock barrel and the other end portion thereof engaged with the lock pin to bias the tab or protrusion out of alignment with the slot to prevent inadvertent depression of the lock pin while enabling an operator to rotate the tab or protrusion into alignment with the slot and thereafter depress the lock pin to provide lock-on effectuation.

* * * * *